United States Patent [19]

Goto

[11] 3,970,420

[45] July 20, 1976

[54] ACTUATING ARRANGEMENTS FOR A CIGARETTE LIGHTER

[75] Inventor: Kenjiro Goto, Saitama, Japan

[73] Assignee: Mansei Kogyo Kabushiki Kaisha, Saitama, Japan

[22] Filed: Oct. 16, 1974

[21] Appl. No.: 515,213

[30] Foreign Application Priority Data

Oct. 18, 1973 Japan ..... 48-120844
Dec. 28, 1973 Japan ..... 49-395

[52] U.S. Cl. ..... 431/255; 431/142
[51] Int. Cl.[2] ..... F23Q 2/16
[58] Field of Search ..... 431/130–132, 431/142, 143, 254, 255

[56] References Cited

UNITED STATES PATENTS

| | | | |
|---|---|---|---|
| 3,402,010 | 9/1968 | Rabe | 431/142 |
| 3,479,125 | 11/1969 | Newman | 431/254 |
| 3,764,256 | 10/1973 | Moriya | 431/255 |
| 3,876,366 | 4/1975 | Corte | 431/254 |

*Primary Examiner*—Carroll B. Dority, Jr.
*Attorney, Agent, or Firm*—Robert E. Isner

[57] ABSTRACT

A lighter has an actuator for an ignition mechanism and a fuel spout valve, which is mounted on a mounting block rotatably around a longitudinally central axis of a lighter casing for actuation, wherein the actuator constitutes a partial peripheral surface surrounding the lighter. A burner is also positioned on the longitudinally central axis of the lighter casing.

17 Claims, 14 Drawing Figures

Figure 1:
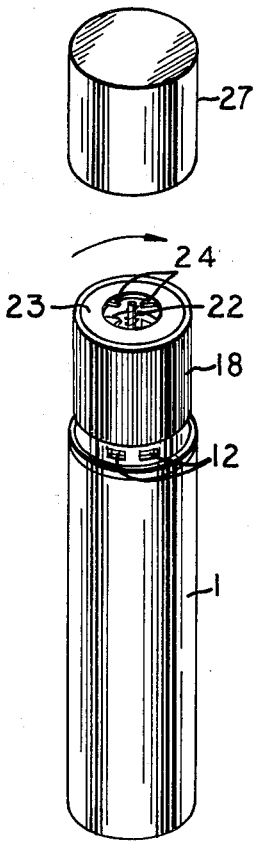

FIG. 8
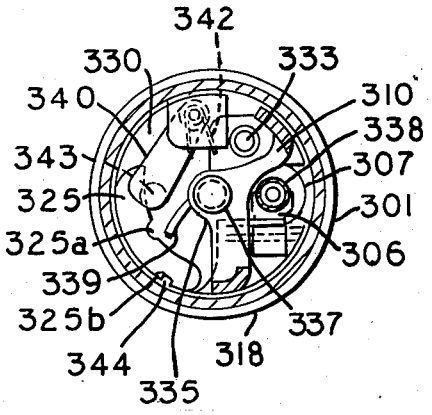
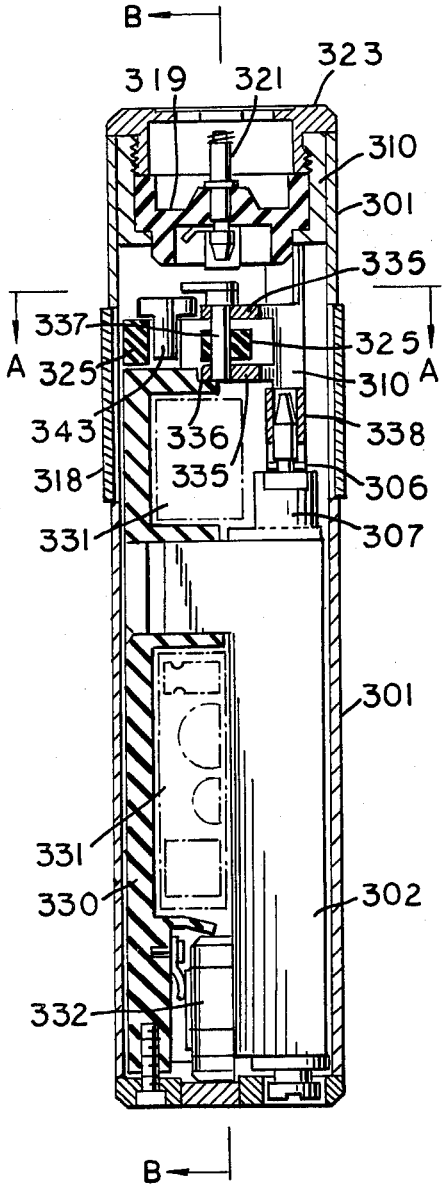
FIG. 7
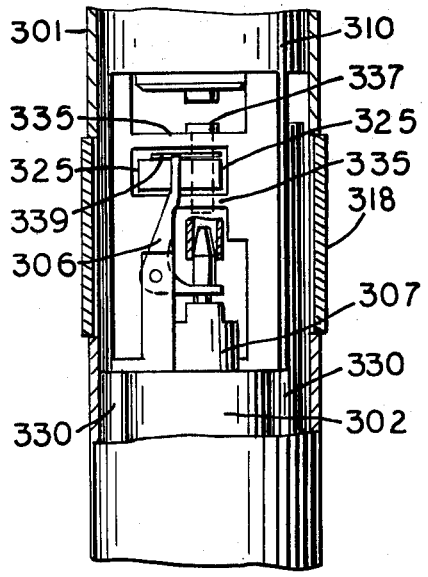
FIG. 9

FIG. 14
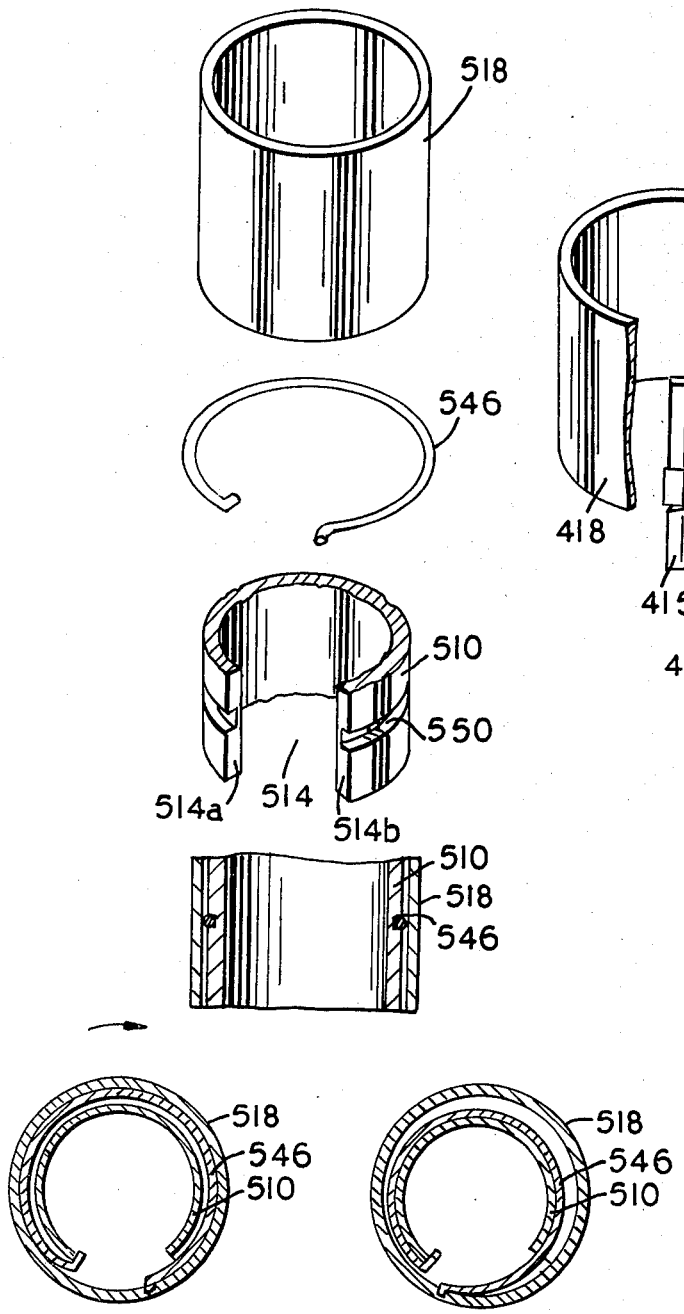
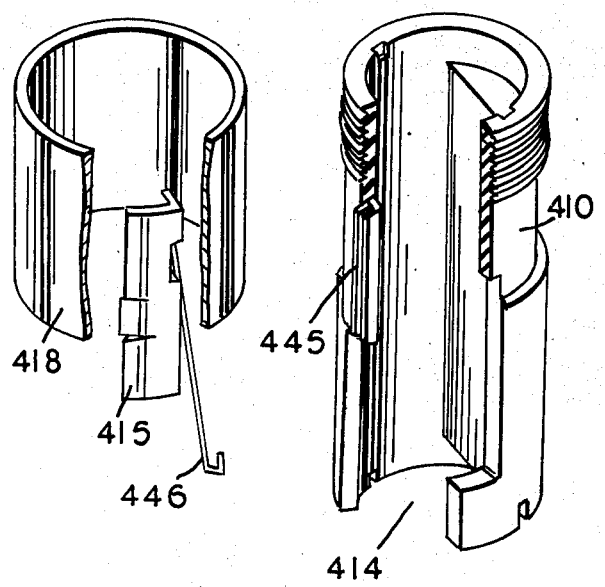
FIG. 13

ACTUATING ARRANGEMENTS FOR A CIGARETTE LIGHTER

The present invention relates to actuating arrangements for an ignition mechanism and a burner valve in a cigarette lighter.

In the conventional lighters, it is known to form an actuator as a roller, a hinged cover or a spring-biased lever, rotatable around a horizontal or vertical axis of the lighter. However these known actuators make the whole lighter more or less bulky and also spoil the appearance of the lighter. It it also known to form an actuator as a push button. Such an actuator is rather dangerous because of its unexpected operation when the lighter is a pocket lighter.

For example, a lighter having a horizontally rotatable actuator is known from U.S. Pat. No. 3,612,736 and 3,764,256. In these known lighters, an actuator is arranged on one side surface of a lighter casing to be rotative vertically and outwards of the contour thereof. However such an actuator results in operational difficulty requiring a particular side of the lighter to face to a user of the lighter, and causes partial load on the lighter in actuation. Further, the actuator, when actuated, spoils an appearance of the lighter.

It is therefore an object of the invention to provide an actuating arrangement for a lighter wherein appearance of the lighter is not spoiled by actuation of an actuator.

It is an another object of the invention to provide an actuating arrangement for a lighter which permits small size of the lighter and an actuator of which is easily accessible.

It is a further object of the invention to provide an actuating arrangement for a lighter which maintains the lighter in its operative condition without further or successive operation.

It is a still further object of the invention to provide an actuating arrangement for a lighter which is not operated of its own accord or unexpectedly, for the safety purpose.

According to the invention, there is provided a lighter having a casing including therein an ignition mechanism and a fuel tank having a fuel spout valve which is connected to a burner, an actuator for the ignition mechanism and the spout valve, and a mounting block on the fuel tank to rotatively mount the actuator surrounding the mounting block, wherein the rotational axis of the actuator is on the longitudinally central axis of the casing.

It is advantageous to form both the casing and actuator cylindrical so as to locate them concentrically with each other wherein the actuator constitutes a partial peripheral surface surrounding the lighter. The actuator may have substantially the same diameter with the casing. The burner may be positioned on the longitudinally central axis of the casing, and also may be located in the actuator.

It is also advantageous to locate the actuator with the top end thereof being flushed with the top surface of the lighter.

According to the invention, a diametrically opposed cam surface is provided on the inner periphery of the actuator and a pin engages at its each end the cam surface to follow thereafter along a guide slot perpendicularly to the rotational direction of the actuator so as to operate the ignition mechanism and the spout valve. Alternatively, a pin may be fixed on the inner periphery of the actuator across the inner space thereof, and a cam may be arranged in the actuator with a cam surface thereof supporting the pin wherein the cam is guided perpendicularly to the rotational direction of the actuator. The cam surface may include diametrically opposed recesses in which each end of the pin is held to maintain the lighter in its operative condition.

Further according to the invention, a cam may be provided to operate a switch in the ignition mechanism and the spout valve, and an arresting member may be provided to arrest the cam in its operative position. The cam and arresting member are spring-biased in the opposite direction to each other, and are abutting against each other. The cam is rotated by the actuator. Alternatively, the actuator may have a pusher fixed thereon to operate the switch. The pusher is provided with a return spring of a steel wire.

Figure 2:
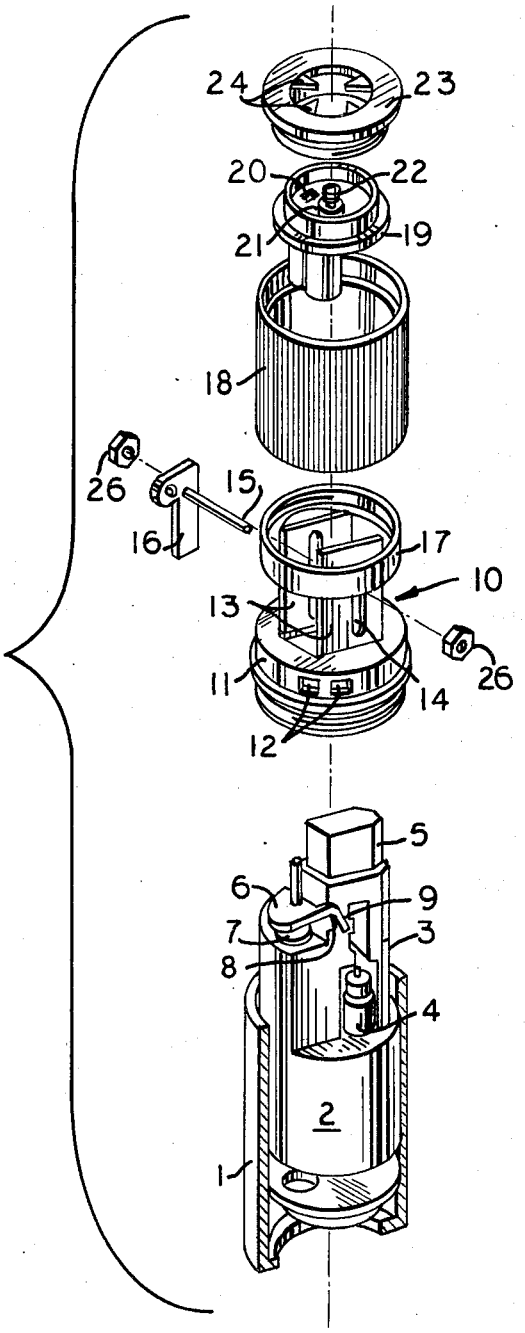
Figure 3:
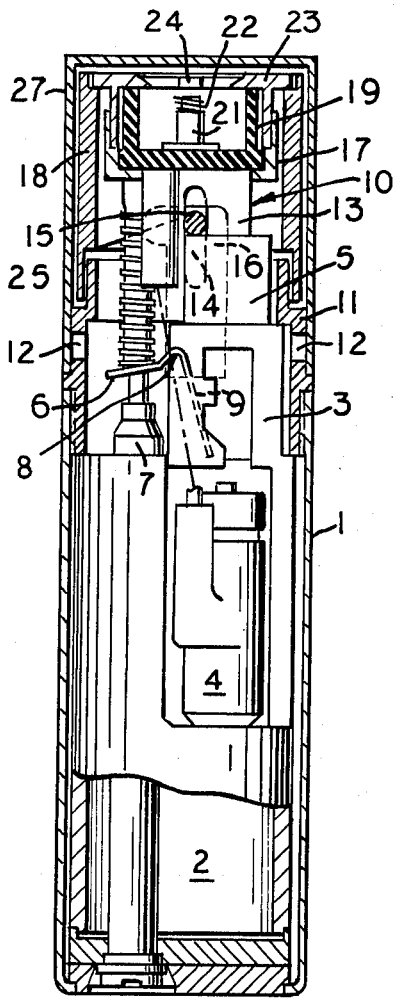
Figure 4:
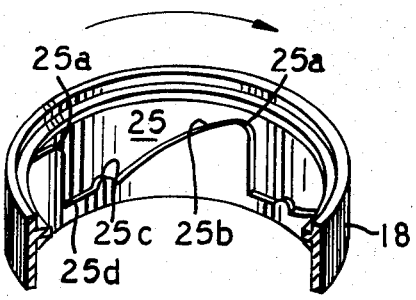
Figure 5:
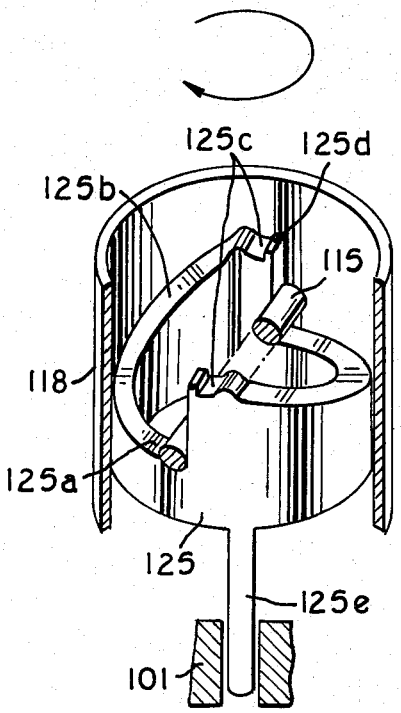
Figure 6:
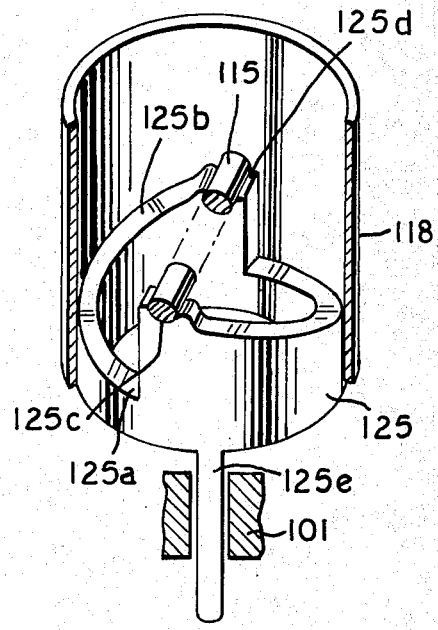
Figure 10:
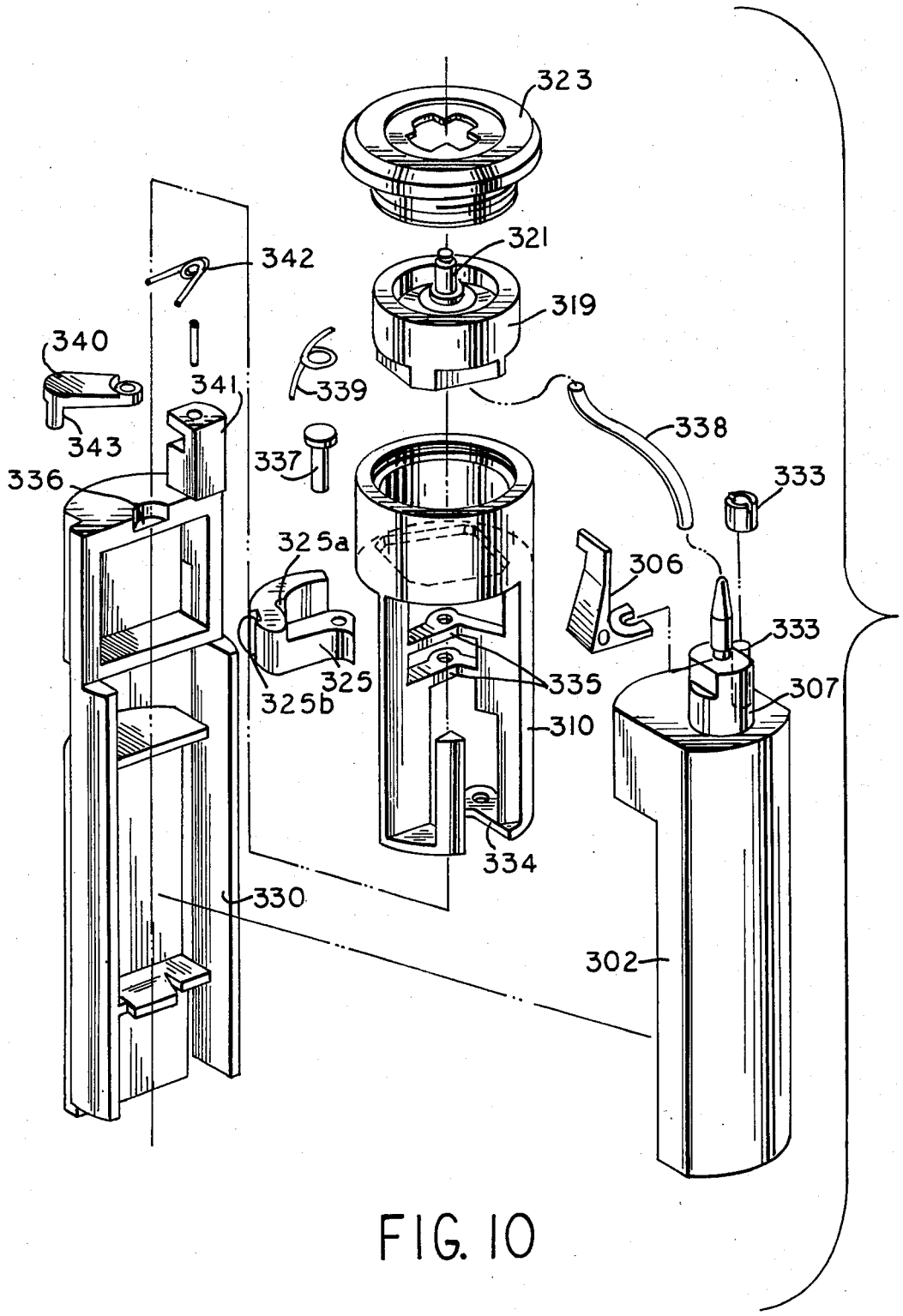
Figure 11:
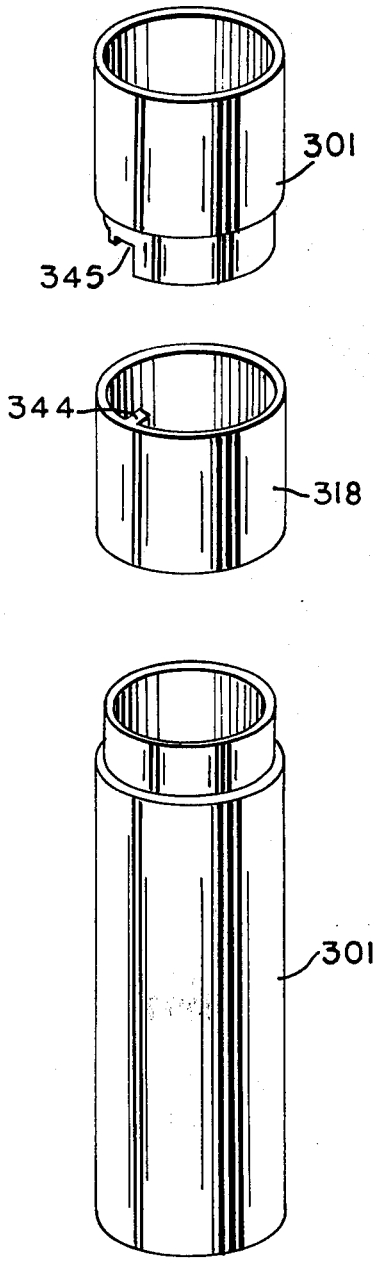
Figure 12:
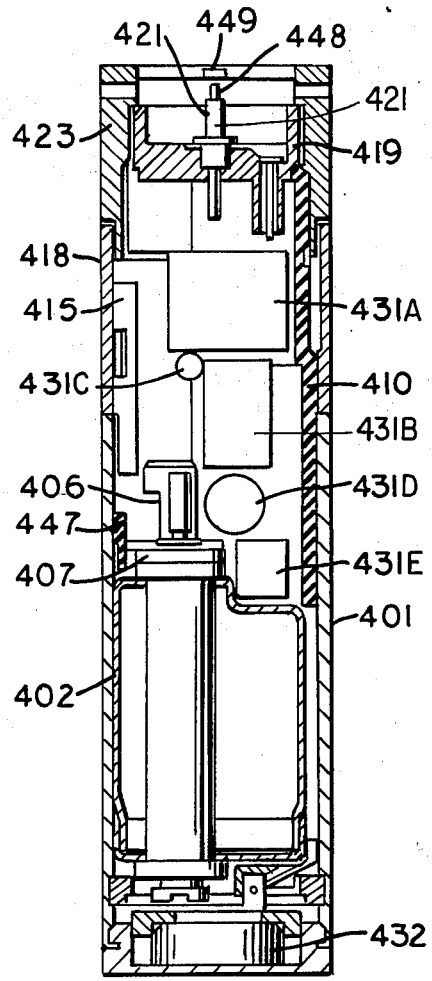

The foregoing and other object and features of the invention will be understood from the following description taken in connection with the accompanying drawings, wherein:

FIG. 1 is a perspective view of a first embodiment of a lighter according to the invention, FIG. 2 is an exploded perspective view of the lighter in FIG. 1, FIG. 3 is a longitudinal section of the lighter in FIG. 1, FIG. 4 is a developed view of an actuator in the lighter in FIG. 2, FIG. 5 is a perspective view showing a modification of the actuating arrangement for the lighter in FIG. 2, FIG. 6 is a perspective view of the arrangement in FIG. 5 in an operative condition, FIG. 7 is a longitudinal section of a second embodiment of a lighter according to the invention, FIG. 8 is a cross section along a line A—A in FIG. 7, FIG. 9 is a partial longitudinal section along a line B—B in FIG. 7, FIG. 10 is an exploded perspective view of the lighter in FIG. 7, FIG. 11 is a perspective view showing positional relation of a casing and actuator, FIG. 12 is a longitudinal section of a third embodiment of a lighter according to the invention, FIG. 13 is an exploded and partially broken perspective view showing the actuating arrangement in FIG. 12, and FIG. 14 is a view showing a modification of the actuating arrangement in FIG. 13.

Now referring to FIGS. 1 to 3, in a cylindrical casing 1 there is arranged a fuel tank 2 which is associatedly formed with a chassis 3 for a piezoelectric generator. The piezoelectric generator includes a reciprocable operative member 5, a piezoelectric element unit 4 and a hammer (not shown) to strike the element unit. A fuel spout valve 7 is fixed on the upper end of the fuel tank 2. A valve opening member 6 formed as a valve lifter is engaged at its one end with a valve stem of the valve 7 and is supported on a fulcrum 8 on the fuel tank 2 with a shank portion 9 extending beyond the fulcrum 8. The valve opening member 6 is swingable around the fulcrum 8 to open and close the valve 7.

At the upper end of the casing 1 is screwed a hollow mounting block 10 of a slightly smaller diameter than that of the casing 1, so that the fuel tank 2 is fixed under the block 10 in the casing 1. The operative member 5, spout valve 7 and other upper portions of the fuel tank 2 are received in a hollow space of the mounting block 10. Air intakes 12 for a burner are formed on a periphery of a circular base 11 of the mounting block 10. A pair of spaced standing walls 13 extends upwards from the base 11. Each of the walls 13 has a guide slot 14 through which a horizontal pin 15 extends. The pin 15 abuts on the upper end of the operative member 5 to operate the piezoelectric generator. The pin 15 also carries a plate 16 which is adapted to push the shank portion 9 of the valve opening member 6 to rotate the same for opening operation of the spout valve 7. A circular guide member 17 is associatedly formed at the upper portion of the standing walls 13 to guide operative movement of cylindrical actuator 18 which is arranged around the guide member 17 and on the base 11, wherein the vertical axis of the actuator 18 is on the longitudinally central axis of the casing 1. A support 19 of heat resistant and electrically insulative material is mounted on the upper ends of the walls 13. The support 19 includes an air intake 20 for the burner 21 and supports the burner so as to position the same on the longitudinally central axis of the casing 1. The burner 21 is connected through a flexible tube to the spout valve 7, and also carries a coiled wire 22 as a discharge electrode which is electrically connected to the positive pole of the piezoelectric element unit 4. A circular burner cover 23 with a central opening is screwed into the guide member 17 to hold the support 19 and actuator 18 in their positions.

The cover 23 is arranged concentrically with the casing 1, and the top surface thereof is flushed with the upper end of the actuator 18. The actuator 18 surrounds therein the burner 21, burner support 19 and upper portions of the block 10. The cover 23 is electrically connected to the negative pole of the piezoelectric element unit 4, and two pairs of projections formed on the inner periphery of the cover 23 respectively form a spark gap with the coiled wire 22 on the burner 21.

The cylindrical actuator 18 is of the same diameter with the base 11, and arranged concentrically with the casing 1 to constitute a surface surrounding the upper portion of the lighter. The casing 1, base 11 of the mounting block 10, actuator 18, burner cover 23 and burner 21 are arranged concentrically with each other. Thus the lighter has a substantially columnar contour. In the present embodiment, the cross section of the lighter is a circule. But it is to be understood that such cross section is freely changeable to, for example, square, pentagon, hexagon and other polygons.

The outer periphery of the actuator 18 is knurled so that a user's finger may not slip off on actuation. On the inner periphery of the actuator 18 there is provided a cam 25 of which cam surface is diametrically opposed and continuously extending around the inner periphery of the actuator 18 (see FIG. 4). The cam 25 engages both ends of the pin 15 through collars 26 synthetic resin for up and down movement of the pin 15. In the inoperative condition of the lighter, the pin 15 is rested at the uppermost portion 25*a* of the cam 25. When the actuator 18 is rotated in the direction shown by an arrow, the pin 15 is depressed down along slants 25*b* of the cam 25 and also along the guide slots 14 in the standing walls 13 to depress the operative member 5 in the piezoelectric generator for actuation thereof. At the same time, the plate 16 on the pin 15 pushes the valve opening member 6 to open the spout valve 7. After actuation of the valve 7 and the piezoelectric generator to ignite fuel at the spark gap, the pin is rested in a recess 25*c* of the cam 25 to maintain the ignited flame. When the flame is to be extinguished, the actuator 18 is further rotated in the arrow direction for the pin 15 to slide over a shoulder 25*d* of the cam 25, or it is rotated in the reversed direction for the pin 15 to be on the slants 25*b*. Then the pin 15 is returned to its initial inoperative position in the uppermost portion 25*a* of the cam 25 by means of a return spring (not shown) in the piezoelectric generator. The spout valve 7 is also returned to the closed condition by a return spring therein.

A cylindrical cover member 27 of the same diameter with the casing 1 may be provided to cover the burner 21, electrodes 24, actuator 18 and air intakes 12. In case that the cover member 27 is not provided, the actuator 18 and the base 11 of the mounting block 10 may be formed equally to the casing 1 in diameter.

FIGS. 5 and 6 show a modification of the actuating arrangement according to the invention, wherein on the inner side of an cylindrical actuator 118 there is fixed a horizontal pin 115 diametrically across the inner space of the actuator 118. A substantially cylindrical cam 125 has, in this arrangement, a cam surface at the upper edge thereof along which the pin 115 is operated. The cam surface is arranged in and concentrically with the actuator 118. The cam surface of the cam 125 has a pair of lowermost portions 125*a*, slants 125*b*, recesses 125*c* and shoulders 125*d* all of which are diametrically opposed respectively so as to receive the pin 115 thereon. The lower edge of the cam 125 is adapted to operate an operative member (not shown) in an ignition mechanism. The lower edge of the cam 125 is also provided with an extension 125*e* which is guided in a bore formed in a casing or mounting block 101, so as to prevent the cam 125 from rotational movement.

In the inoperative condition, the pin 115 is rested at the lowermost portion 125*a* of the cam 125. When the actuator 118 is rotated in the arrow direction, the pin 115 rotates along with the actuator in engagement with the slants 125*b* to depress the cam 125 downwards for actuation of the ignition mechanism and a fuel spout valve. On rotating the actuator 118 to the predetermined position where the pin 115 is rested in the recesses 125*c*, the lighter is maintained in the operative condition. When the actuator 118 is further rotated in the arrow direction for the pin 125 climb over the shoulder 125*d*, or it is rotated in the reversed direction for the pin 115 to be on the slants 125*b*, the cam 125 is returned to its inoperative position by a return spring (not shown).

FIGS. 7 to 10 show a second embodiment of the invention adapted for a battery operated lighter. A cylindrical casing 301 includes a chassis 330 of electrically insulative material having recesses which receive respectively a fuel tank 302, electric elements 331 for an ignition circuit, and a battery 332. A fuel spout valve 307 is arranged on the top of the tank 302. A mounting block 310 is located laterally to the chassis 330 and on the top of the tank 302 with a bottom wall 334 thereof secured by screws 333. A pair of middle walls 335 of the block 310 are positioned at a recess 336 on the top of the chassis 330 and pierced by a pin 337. A burner support 319 of heat resistant and electrically insulative material supporting a burner 321 is fitted into an upper recess of the mounting block 310. A metallic burner cap 323 including discharge electrodes of one pole is screwed into the upper end of the block 310 to hold the burner support 319 therebetween. The burner 321 is positioned on the longitudinally central axis of the casing 301, and is connected through a flexible tube 338 to the spout valve 307.

An electrically insulative cam 325 is rotatively supported between the middle walls 325 of the block 310 around the pin 337 being paralleled to the longitudinally central axis of the casing 301. The cam 335 is biased in a counterclockwise direction by a spring 339, and has a portion adapted to engage one end of a pivotable L-shaped valve opening member 306 of which the other end engages a valve stem of the spout valve 307. The cam 325 also includes a first groove 325*a* and a second groove 325*b*. A metallic arresting member 340 is rotatively supported around an axis parallel to the longitudinally central axis of the casing 301 at a hinge 341 on the top of the chassis 330, and is biased in a clockwise direction by a spring 342. The arresting member 340 includes a projection 343 which is adapted to engage the first groove 325*a* on the cam 325 so as to hold the cam in a predetermined position. The clockwise rotational motion of the member 340 is always limited with projection 343 thereof resiliently abutting against the cam 325. The projection 343 is adapted to be in contact with the spring 339 around the pin 337 when the projection 343 is in the groove 325*a*. The projection 343 of metallic arresting member 340 and the spring 339 for the cam 325 are designed to constitute therebetween a switch for the ignition circuit.

A cylindrical actuator 318 of substantially the same diameter with the casing 301 is rotatively arranged around the casing 301 (see FIG. 11). A projection 344 on the inner surface of the actuator 318 projects into the casing through an opening 345 therein so as to engage the second groove 325*b* on the cam 325. When the actuator 318 is rotated in the clockwise direction and relative to the casing 301, the cam 325 is also rotated in the same direction through the engagement with the actuator 318 to operate the valve opening member 306 for opening the spout valve 307. On further rotation of the actuator 318, the projection 343 on the arresting member 340 engages the first groove 325*a* on the cam 325 to turn on the switch in the ignition circuit and to lock the cam 325 in the operative position thereof by the force of the spring 342. Thus ignition spark is produced between the burner cap 323 and burner 321 to ignite fuel, and the flame is maintained. When the flame is to be extinguished, the actuator 318 is rotated by a user in the counterclockwise direction so as to disengage the projection 343 from the groove 325*a* on the cam 325. Then the cam 325 and actuator 318 are automatically returned to its initial inoperative position by the force of the spring 339. The spout valve 307 is also returned to the closed position by a return spring therein. Referring to FIG. 12, which schematically illustrates the components of a battery powered ignition circuit, there is provided a battery 432 connected with a conventional DC-DC converter. Such conventional DC-DC converter may include a conventional transistor for switching, a diode serving as a half-wave rectifier means and a transformer 431B forming a component of an oscillation circuit.

Also included therein is a condenser 431D and a silicon controlled rectifier 431C connected in parallel with the DC-DC converter. A trigger diode 431E may be connected with the gate of the silicon controlled rectifier 431C, which has the primary side of a step-up transformer 431A connected in series therewith. A spark gap which is formed by the nozzle 448 and electrode 449 is switchably connected to the secondary side of the step-up transformer 431A.

FIGS. 12 and 13 show a third embodiment of the invention equally adapted for a battery operated lighter. A cylindrical casing 401 includes a mounting block 410 of electrically insulative material accommodating the circuit components generally designated electric 431 for the ignition circuit. The mounting block 410 is supported on a top of a fuel tank 402 under which a battery 432 is located. On the upper end of the mounting block 410 is mounted a burner support 419 supporting a burner 421 which is positioned on the longitudinally central axis of the casing 401. A circular burner cap 423 of metal is screwed around the upper end of the block 410 to fix the burner support 419 therebetween. A cylindrical actuator 418 is rotatively arranged between the casing 401 and burner cap 423 and around the upper portion of the mounting block 410 which is projected from the upper open end of the casing 401. A pusher 415 of L-shaped cross section is fixed on the inner surface of the actuator 418 so as to be positioned in the longitudinal cutout 414 of the block 410. On one cutting surface of the cutout 414 there is arranged a pair of metallic pieces 445 constitute a switch for the ignition circuit and which are normally insulated and separated from each other. This switch 445 is adapted to be turned on by the pusher 415 which is also adapted to rotate clockwise to push an L-shaped valve opening member 406 to open a fuel spout valve 407 which is fixed on the fuel tank 402 and which is connected to the burner 421 through a correcting tube. One end of a steel wire 446 is hung on the actuator 418 while the other end thereof is hung on the casing at 447 so as to return the actuator 418 in its inoperative position.

When the actuator 418 is rotated in the clockwise direction by a user, the pusher 415 is also moved in the same direction against the torsional and tensional force of the steel wire 446 so as to operate the valve opening member 406 for opening the valve 407. On further rotation of the actuator 418, the pusher 415 makes the metallic pieces 445 contact with each other to turn on the switch in the ignition circuit. As is conventional, when the switch 445 in the ignition circuit is turned on, the voltage of the battery 432 is applied to the DC-DC converter so as to be effectively stepped up. The condenser 431D is charged with the half-wave voltage obtained through the DC-DC converter. When the charged voltage of the condenser 431D reaches a predetermined value, the silicon controlled rectifier 431C fires, whereby the electric charge of the condenser 431D is rapidly discharged through the silicon controlled rectifier 431C to the primary side of the step-up transformer 431A. Then, the step-up transformer 431A steps up the voltage of the primary side thereof to induce a higher voltage at the secondary side thereof. Thus fuel is ignited by a spark discharge at a voltage gap formed between a nozzle 448 on the burner 421 and an electrode 449 on the burner cap 423. When actuating force on the actuator 418 by the user is eliminated, the actuator 418 is returned to its initial inoperative position under the force of the wire 446 and other component parts operate in a way contrary to the above mentioned.

FIG. 14 shows a modification of the embodiment described in connection with the FIGS. 12 and 13. A cylindrical mounting block 510 having a longitudinal cutout 514 is formed with a peripheral groove 550 therearound from one cutting edge 514*a* to the other such edge 514*b* of the block 510.

A cylindrical actuator 518 is concentrically arranged around the block 510 with a ringed steel wire 546 there between. The steel wire 546 is arranged around the groove 550 of the block 510 wherein one end of the wire 546 is hung at the cutting edge 514*b* while the other end thereof is hung on the inner surface of the actuator 518. Thus the actuator is resiliently maintained in its inoperative rest position. When the actuator 518 is rotated in the clockwise direction shown by an arrow, the steel wire 546 is tensioned and twisted to be received in the peripheral groove 550 on the mounting block 510. So, when the actuator 518 is released by the user, it is returned to its initial inoperative position by the wire 546.

In this specification and the appended claims, the words "side", "upper", "lower", "vertical", "horizontal" and "longitudinal" are to be interpreted with reference to the usual operative condition of a pocket lighter wherein the lighter is held vertically to produce a flame at the top thereof.

It is also to be understood that the invention is not limited to the exact constructions as described and shown in connection with the embodiments and their modifications, especially not limited to the lighters having particular ignition source described.

What is claimed is:

1. A lighter comprising a casing having a cylindrical shape;

a fuel tank disposed within said casing;

a fuel spout valve fixed on said fuel tank;

a burner connected to said fuel spout valve through a connecting tube;

a valve opening member for controlling said fuel spout valve to issue fuel gas from said burner;

a spark gap provided around said burner;

an ignition mechanism housed in said casing for discharging a spark at the spark gap so as to ignite the fuel gas emitted by said burner;

an actuator supported to said casing and rotatable around a longitudinal axis of said casing;

means operatively associated with said actuator for transmitting the rotational movement of said actuator to said ignition mechanism and to said valve opening member whereby to operate said ignition mechanism and said valve opening member; and a mounting block located on said fuel tank and supported on said actuator for mounting said actuator rotatably around a longitudinally central axis of said casing.

2. A lighter as set forth in claim 1, wherein said actuator has a cylindrical shape and is located concentrically with said casing, and wherein said actuator constitutes a partial peripheral surface of the lighter.

3. A lighter as set forth in claim 2, wherein said casing and said actuator have substantially the same external diameter.

4. A lighter as set forth in claim 2, wherein said burner is positioned on the longitudinally central axis of said casing.

5. A lighter as set forth in claim 2, wherein said burner is located in the actuator.

6. A lighter as set forth in claim 2, including a burner support for supporting said burner and located on said mounting block, and a burner cover member for securing said burner support on said mounting block, wherein said burner support and said burner cover member are positioned concentrically with said casing.

7. A lighter as set forth in claim 6, wherein a top surface of said burner cover member is positioned flush with the upper end of said actuator irrespective of the position of said actuator.

8. A lighter as set forth in claim 2, and including a diametrically opposed cam surface provided on the inner periphery of the actuator;

a pin having its ends disposed in operative engagement with the cam surface;

means connecting said pin to said ignition mechanism; a pair of guide slots formed in the mounting block to guide the pin; and the cam surface including diametrically opposed slants, wherein the pin is guided along the guide slots for displacement perpendicularly to the rotational direction of the actuator so as to operate the ignition mechanism and the spout valve.

9. A lighter as set forth in claim 8, wherein said cam surface includes diametrically opposed recesses in which each end of said pin is held to maintain the lighter in its operative condition.

10. A lighter as set forth in claim 2, including said actuator having a pin fixed thereon across the inner space thereof;

a cam arranged in said actuator to operate said ignition mechanism and said valve opening member and having a diametrically opposed cam surface on which said pin is arranged;

said cam surface including diametrically opposed slants; and said cam having an extension to guide said cam, wherein said cam is guided perpendicularly to the rotational direction of said actuator so as to operate said ignition mechanism and said valve opening member.

11. A lighter as set forth in claim 2, including a cam for operation of said valve opening member and a switch in the ignition mechanism;

an arresting member to arrest said cam in the operative position thereof;

said cam and arresting member being rotatable around axes parallel to the longitudinally central axis of said casing and being spring-biased in the opposite direction to each other; said arresting member resiliently abutting on said cam;

said actuator engaging said cam to rotate the latter; and a projection and recess formed on said cam and said arresting member for engagement therebetween to arrest said cam.

12. A lighter as set forth in claim 11, wherein said cam is made of electrically insulative material and said arresting member is made of electrically conductive material, wherein a spring is arranged on said cam for biasing it, and wherein said projection of said arresting member and said spring on said cam constitutes contact points of said switch which are normally opened and are closed by the rotation of said cam whereby said switch turns on.

13. A lighter as set forth in claim 2, and including a pusher fixed on the inner surface of the actuator and being rotatable therewith to operate the valve opening member and a switch in the ignition mechanism;

contact pieces located on the mounting block in the path of displacement of said pusher constituting the switch in the ignition mechanism; and means for biasing said actuator toward one limiting position thereof.

14. A lighter as set forth in claim 13, wherein said biasing means for said actuator comprises a steel wire arranged between the actuator and the mounting block with its one end hung on the actuator while the other end thereof hung on the mounting block, and a peripheral groove is formed around the mounting block to receive the steel wire.

15. A lighter as set forth in claim 2, including a cylindrical cap mounted on said casing to cover said actuator.

16. A lighter as set forth in claim 15, including said burner cap having a flame opening at the center thereof, at least one projection formed on the periphery of said flame opening, wherein said spark gap is formed between said projection and said burner.

17. A lighter as set forth in claim 16, wherein said burner has a nozzle including a coiled wire, and wherein said projection and said coiled wire form said spark gap.

* * * * *